US008038267B2

(12) United States Patent
Kinase et al.

(10) Patent No.: US 8,038,267 B2
(45) Date of Patent: Oct. 18, 2011

(54) DROPLET JETTING APPLICATOR AND METHOD FOR MANUFACTURING COATED BODY

(75) Inventors: Atsushi Kinase, Yokohama (JP); Haruhiko Ishihara, Yokohama (JP); Yasushi Ooishi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 393 days.

(21) Appl. No.: 12/050,517

(22) Filed: Mar. 18, 2008

(65) Prior Publication Data

US 2008/0239027 A1 Oct. 2, 2008

(30) Foreign Application Priority Data

Mar. 28, 2007 (JP) ..... 2007-085551
Jan. 30, 2008 (JP) ..... 2008-019536

(51) Int. Cl.
*B41J 2/175* (2006.01)
*B41J 2/18* (2006.01)
*B41J 2/19* (2006.01)

(52) U.S. Cl. ..... 347/85; 347/89; 347/92

(58) Field of Classification Search ..... 347/85, 347/89, 92

See application file for complete search history.

(56) References Cited

U.S. PATENT DOCUMENTS

| | | | | |
|---|---|---|---|---|
| 3,761,953 | A * | 9/1973 | Helgeson et al. | 347/7 |
| 4,314,264 | A * | 2/1982 | Bok et al. | 347/89 |
| 7,566,121 | B2 * | 7/2009 | Ohishi | 347/89 |
| 2002/0008746 | A1 * | 1/2002 | Naniwa et al. | 347/89 |

FOREIGN PATENT DOCUMENTS

| | | |
|---|---|---|
| JP | 2004-230652 | 8/2004 |
| JP | 2006-192638 | 7/2006 |

OTHER PUBLICATIONS

Office Action issued Feb. 24, 2011 in Chinese Application No. 200810087990.1 (w/English translation).

* cited by examiner

*Primary Examiner* — Geoffrey Mruk
(74) *Attorney, Agent, or Firm* — Oblon, Spivak, McClelland, Maier & Neustadt, L.L.P.

(57) ABSTRACT

Provided is a droplet jetting applicator including: a droplet jetting head configured to jet liquid supplied from a liquid storage unit; a liquid supply unit configured to supply the liquid from the liquid storage unit to the droplet jetting head through a liquid supply channel; a first buffer liquid reservoir positioned closer to the droplet jetting head than the liquid supply unit in the liquid supply channel, and formed so that the inflow liquid drops thereinto; a liquid return unit configured to return the liquid from the droplet jetting head to one of the liquid storage unit and the first buffer liquid reservoir through a liquid return channel; and a second buffer liquid reservoir positioned closer to the droplet jetting head than the liquid return unit in the liquid return channel, and formed so that the inflow liquid drops thereinto.

10 Claims, 7 Drawing Sheets

DROPLET JETTING APPLICATOR AND METHOD FOR MANUFACTURING COATED BODY

CROSS REFERENCE OF THE RELATED APPLICATION

This application is based on and claims the benefit of priority from Japanese Patent Applications No. 2007-85551, filed on Mar. 28, 2007 and No. 2008-19536, filed on Jan. 30, 2008; the entire contents of which are incorporated herein by reference.

BACKGROUND OF THE INVENTION

1. Field of the Invention

The present invention relates to a droplet jetting applicator that jets and thus applies multiple droplets to an object to be coated, and also relates to a method for manufacturing a coated body.

2. Description of the Related Art

Droplet jetting applicators have been used not only for printing of image information, but also for a process of manufacturing various kinds of flat display devices, such as liquid crystal display devices, organic electro luminescence (EL) display devices, electron emission display devices, plasma display devices, and electrophoretic display devices.

Such a droplet jetting applicator includes a droplet jetting head (for example, an inkjet head) that jets droplets of a liquid, such as an ink, from multiple nozzles thereof to an object, such as a substrate, to which the liquid is to be applied (hereinafter, such object will be referred to as an application target). Multiple droplets are jetted to land on the application target by the droplet jetting head, so that a predetermined application pattern is formed. In this manner, various kinds of coated bodies are manufactured.

The ink is supplied from an ink tank to the droplet jetting head through a pipe (ink channel). The pipe is provided with a valve, a pump and the like. Note that, the liquid pressure of the ink in the droplet jetting head is maintained at a negative pressure in order to prevent troubles, such as the leakage of the ink from the nozzles (see, for example JP-A No. 2006-192638(KOKAI)).

Such a droplet jetting applicator uses ink containing an almost insoluble material. When such ink is deteriorated with time, the material thereof settles down. This settling causes jetting failure in the droplet jetting applicator. To solve this problem, there has been proposed a droplet jetting applicator in which ink circulates between a droplet jetting head and an ink tank (see, for example, JP-A No. 2004-230652(KOKAI)).

However, in the above-described droplet jetting applicator, pressure fluctuation caused by the drives of the valve and pump is transmitted to the droplet jetting head through the ink in the pipe, and causes leakage of the ink, absorption of air, and the like. As a result, exudation of the ink to a nozzle surface and absorption of air bubbles into the droplet jetting head are caused, thereby resulting in jetting failure such as a non-jetting problem.

SUMMARY OF THE INVENTION

An object of the present invention is to provide a droplet jetting applicator capable of suppressing the occurrence of jetting failure and a method for manufacturing a coated body.

A first aspect of the present invention provides a droplet jetting applicator including a liquid storage unit, a droplet jetting head, a liquid supply channel, a liquid supply unit, a first buffer liquid reservoir, a liquid return channel, a liquid return unit, and a second buffer liquid reservoir. The liquid storage unit is configured to store liquid. The droplet jetting head has an inner channel through which the liquid supplied from the liquid storage unit passes, and configured to jet, as a droplet, the liquid passing through the inner channel. The liquid supply channel is configured to connect the liquid storage unit and the inner channel of the droplet jetting head so as to supply the liquid from the liquid storage unit to the droplet jetting head. The liquid supply unit is provided in the liquid supply channel, and configured to supply the liquid from the liquid storage unit to the droplet jetting head through the liquid supply channel. The first buffer liquid reservoir is provided in the liquid supply channel so as to be positioned closer to the droplet jetting head than the liquid supply unit, and formed so that the liquid flowing from the liquid supply channel drops thereinto and thereafter is reserved therein. The liquid return channel is configured to connect the inner channel of the droplet jetting head and one of the liquid storage unit and the first buffer liquid reservoir so as to return the liquid having passed through the inner channel of the droplet jetting head from the liquid jetting head to the one of the liquid storage unit and the first buffer liquid reservoir. The liquid return unit is provided in the liquid return channel, and configured to return the liquid having passed through the inner channel of the droplet jetting head from the liquid jetting head to one of the liquid storage unit and the first buffer liquid reservoir through the liquid return channel. The second buffer liquid reservoir is provided in the liquid return channel so as to be positioned closer to the droplet jetting head than the liquid return unit, and formed so that the liquid flowing from the liquid return channel drops thereinto and thereafter is reserved therein.

A second aspect of the present invention provides a droplet jetting applicator including a liquid storage unit, a droplet jetting head, a liquid supply channel, a liquid supply unit, a first buffer liquid reservoir, a liquid return channel, a liquid return unit, an on-off valve, a pressurizing unit, a liquid vessel, a moving mechanism, and a controller. The liquid storage unit is configured to store liquid. The droplet jetting head has an inner channel through which the liquid supplied from the liquid storage unit passes, and a nozzle surface on which a nozzle connected with the inner channel is formed. The droplet jetting head is configured to jet, from the nozzle, the liquid passing through the inner channel as a droplet. The liquid supply channel is configured to connect the liquid storage unit and the inner channel of the droplet jetting head so as to supply the liquid from the liquid storage unit to the droplet jetting head. The liquid supply unit is provided in the liquid supply channel, and is configured to supply the liquid from the liquid storage unit to the droplet jetting head through the liquid supply channel. The first buffer liquid reservoir is provided in the liquid supply channel so as to be positioned closer to the droplet jetting head than the liquid supply unit, and formed so that the liquid flowing from the liquid supply channel drops thereinto and thereafter is reserved therein. The liquid return channel is configured to connect the inner channel of the droplet jetting head and the liquid storage unit so as to return the liquid having passed through the inner channel of the droplet jetting head from the droplet jetting head to the liquid storage unit. The liquid return unit is provided in the liquid return channel, and configured to return the liquid having passed through the inner channel of the droplet jetting head from the droplet jetting head to the liquid storage unit. The on-off valve is configured to open and close the liquid return channel. The pressurizing unit is configured to pressurize the liquid in the inner channel of the droplet jetting head through the first buffer liquid reservoir. The liquid vessel is configured to store liquid in which the nozzle surface of the droplet jetting head is soaked. The moving mechanism is configured to move the droplet jetting head and the liquid vessel relative to each other so that the nozzle surface of the droplet jetting head can be soaked into the liquid in the liquid vessel. The controller is configured to perform circulation preparation control. In the circulation preparation control, the on-off valve is firstly closed, the liquid in the inner channel of the droplet jetting head is discharged from the nozzle by using the pressuring unit to adhere onto a tip of the nozzle as a spherical drop, while the on-off valve is closed, the moving mechanism soaks, in the liquid in the liquid vessel, the nozzle surface of the droplet jetting head with the drop adhered thereto, and the on-off valve is opened while the nozzle surface of the droplet jetting head is soaked in the liquid in the liquid vessel.

A third aspect of the present invention provides a method for manufacturing a coated body, including the step of applying a droplet to an application target by using the droplet jetting applicator according to one of the above-described first and second aspects of the present invention.

DESCRIPTION OF THE PREFERRED EMBODIMENTS

First Embodiment

A first embodiment of the present invention will be described by referring to FIGS. 1 to 3.

Figure 1:
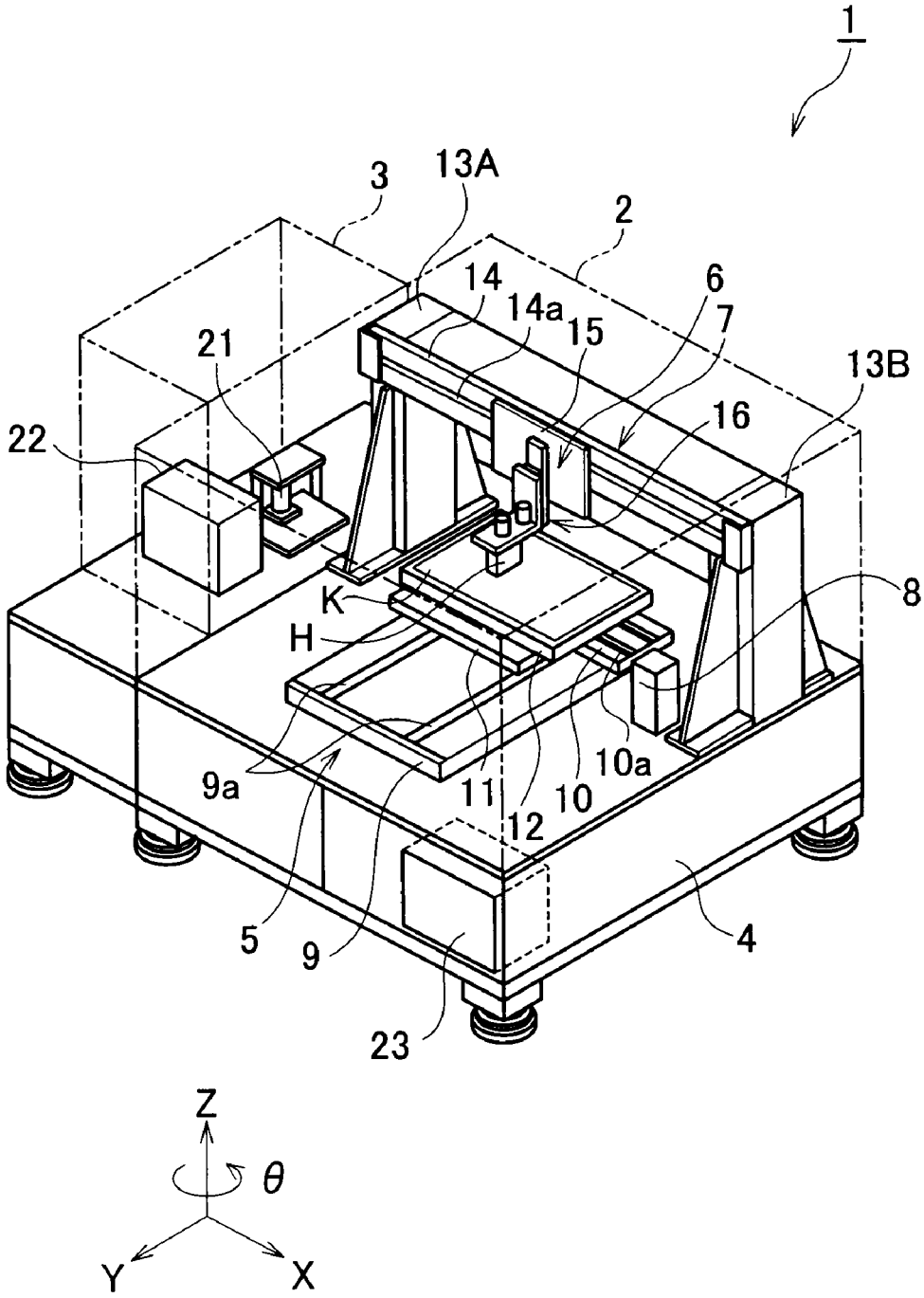
FIG. 1 is a perspective view showing an outline configuration of a droplet jetting applicator according to a first embodiment of the present invention.

As shown in FIG. 1, a droplet jetting applicator 1 according to the first embodiment of the present invention includes an ink application box 2 and an ink supply box 3. The ink application box 2 applies liquid ink as droplets to a substrate K that is an application target. The ink supply box 3 supplies the ink to the ink application box 2. The ink application box 2 and the ink supply box 3 are fixed, adjacent to each other, to the upper surface of a base 4.

Inside the ink application box 2, provided are a substrate moving mechanism 5, a droplet-jetting-head unit 6, a unit moving mechanism 7, and a head maintenance unit 8. The substrate moving mechanism 5 holds the substrate K, and moves the substrate K in the X direction and the Y direction. The droplet-jetting-head unit 6 includes a droplet jetting head H that jets droplets to the substrate K on the substrate moving mechanism 5. The unit moving mechanism 7 moves the droplet-jetting-head unit 6 in the X direction. The head maintenance unit 8 cleans up the droplet jetting head H.

The substrate moving mechanism 5 includes a Y-direction guide plate 9, a Y-direction moving table 10, an X-direction moving table 11, and a substrate holding table 12. The Y-direction guide plate 9, the Y-direction moving table 10, the X-direction moving table 11, and the substrate holding table 12 are all formed in a plate shape, and are stacked on the upper surface of the base 4.

The Y-direction guide plate 9 is fixed to the upper surface of the base 4. Multiple guide grooves 9*a* are provided, along the Y direction, in the upper surface of the Y-direction guide plate 9. These guide grooves 9*a* guide the Y-direction moving table 10 in the Y direction.

The Y-direction moving table 10 has, on the lower surface thereof, multiple protrusions (not illustrated), each engaging with a corresponding one of the guide grooves 12*a*. The Y-direction moving table 10 is provided on the upper surface of the Y-direction guide plate 9 so as to be movable in the Y direction. Moreover, multiple guide grooves 10*a* are provided, along the X direction, in the upper surface of the Y-direction moving table 10. The Y-direction moving table 10 is moved in the Y direction, along the guide grooves 9*a*, by a feed mechanism (not illustrated) using a feed screw and a drive motor.

The X-direction moving table 11 has, on the lower surface thereof, multiple protrusions (not illustrated), each engaging with a corresponding one of the guide grooves 10*a*. The X-direction moving table 11 is provided on the upper surface of the Y-direction moving table 10 so as to be movable in the X direction. The X-direction moving table 11 is moved in the X direction, along the guide grooves 10*a*, by a feed mechanism (not illustrated) using a feed screw and a drive motor.

The substrate holding table 12 is fixed to the upper surface of the X-direction moving table 11. The substrate holding table 12 includes a suction mechanism (not illustrated) for sucking the substrate K. The substrate holding table 12 fixes and thus holds the substrate K on the upper surface of the table 12 by using the suction mechanism. As the suction mechanism, an air suction mechanism is used, for example.

The unit moving mechanism 7 includes a pair of support columns 13A and 13B, an X-direction guide plate 14, and a base plate 15. The pair of support columns 13A and 13B stand on the upper surface of the base 4. The X-direction guide plate 14 is joined to the upper end portions of these support columns 13A and 13B, and extends in the X direction. The base plate 15 is provided on the X-direction guide plate 14 so as to be movable in the X direction, and supports the droplet-jetting-head unit 6.

The pair of support columns 13A and 13B is provided to sandwich the Y-direction guide plate 9 in between in the X direction. In addition, a guide groove 14*a* is provided along the X direction in the front surface of the X-direction guide plate 14. The guide groove 14*a* guides the base plate 15 in the X direction.

The base plate 15 has, on the back surface thereof, a protrusion (not illustrated) engaging with the guide groove 14*a*, and is provided on the X-direction guide plate 14 so as to be movable in the X direction. The base plate 15 is moved in the X direction, along the guide groove 14*a*, by a feed mechanism (not illustrated) using a feed screw and a drive motor. On the front surface of such base plate 15, a droplet-jetting-head unit 6 is mounted.

Figure 2:
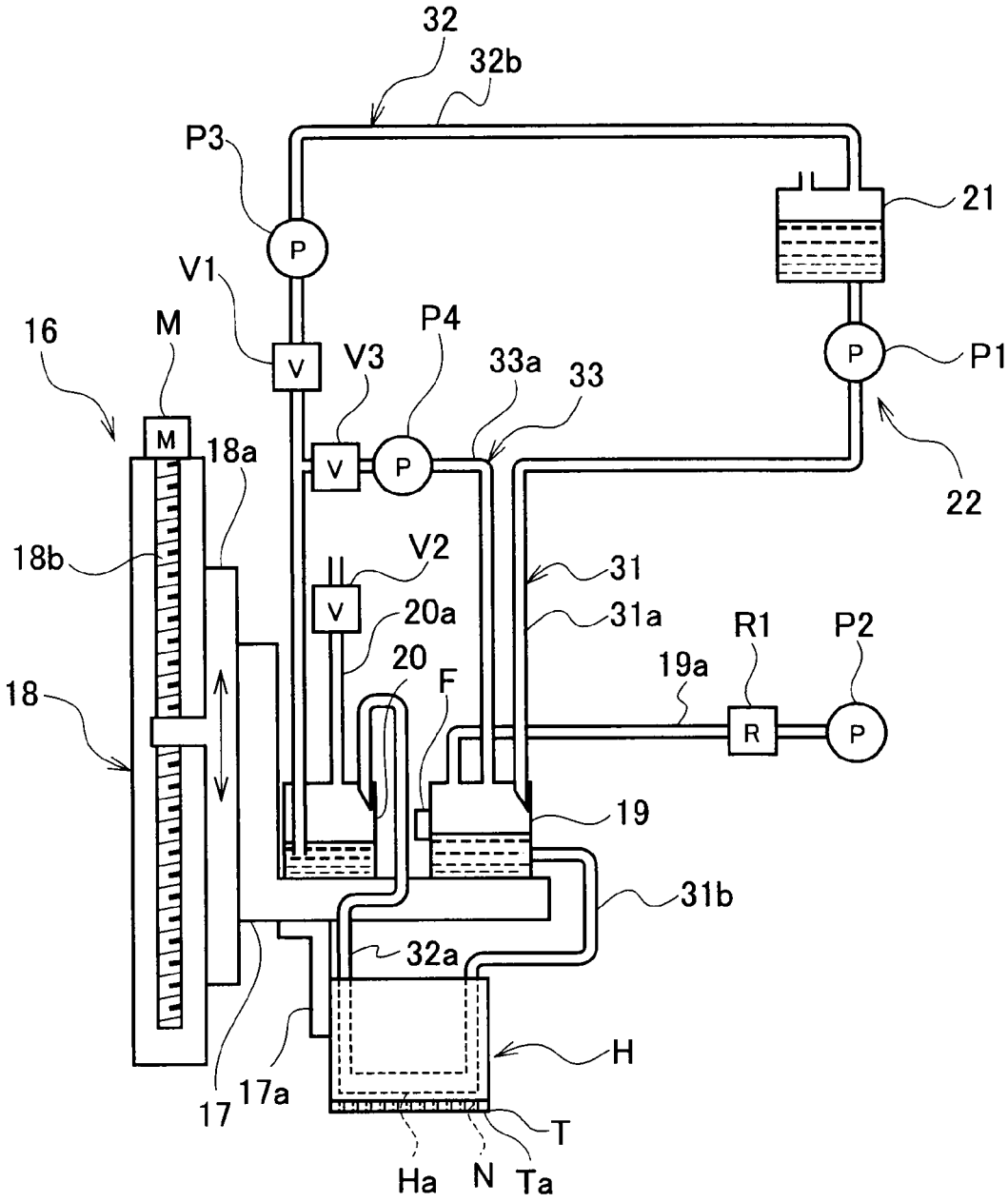
FIG. 2 is a schematic view showing an outline configuration of units involved in ink circulation of the droplet jetting applicator shown in FIG. 1.

As shown in FIGS. 1 and 2, the droplet-jetting-head unit 6 includes a droplet jetting head H and a support moving mechanism 16. The droplet jetting head H jets multiple droplets onto the surface of the substrate K on the substrate holding table 12. The support moving mechanism 16 is fixed to the base plate 15 and supports the droplet jetting head H in a manner that the droplet jetting head H is movable.

The droplet jetting head H includes a nozzle plate T (see FIG. 2), multiple piezoelectric elements (not illustrated), and the like. The nozzle plate T has multiple nozzles (through-holes) N for jetting droplets therethrough, while the piezoelectric elements are provided to correspond to the respective nozzles N. These nozzles N are provided in-line at a predetermined pitch in the nozzle plate T. The outer surface of the nozzle plate T functions as a nozzle surface Ta. The number of the nozzles N is, for example, on the order of 64, 128, or 256. The diameter of each nozzle is, for example, on the order of 20 μm to 60 μm. The pitch of the nozzles N is, for example, on the order of 0.5 mm. The droplet jetting head H jets droplets (ink droplets) through the nozzles N to the substrate K in response to application of driving voltages to the piezoelectric elements, respectively. The droplet jetting head H thereby applies droplets to the surface of the substrate K, thus forming a predetermined application pattern on the surface.

As shown in FIG. 2, the support moving mechanism 16 includes a supporting member 17 and a Z-direction moving mechanism 18. The supporting member 17 supports the droplet jetting head H, while the Z-direction moving mechanism 18 moves the supporting member 17 in a direction perpendicular to the application surface of the substrate K on the substrate holding table 12, that is, in the Z direction. Thereby, the droplet jetting head H is allowed to move in the Z direction.

The supporting member 17 is a member that supports the droplet jetting head H through a mount member 17*a*. The droplet jetting head H is mounted on a surface, facing the substrate holding table 12, of the supporting member 17 by using the mount member 17*a*. First and second buffer tanks 19 and 20, which store ink, are provided on the supporting member 17. These first and second buffer tanks 19 and 20 are placed side by side on the opposite surface to the surface on which the droplet jetting head H is mounted.

The Z-direction moving mechanism 18 includes a moving base 18*a*, a screw shaft 18*b*, and a motor M. The moving base 18*a* is provided so as to be movable in the Z direction, and on the moving base 18*a*, the supporting member 17 is mounted. The screw shaft 18*b* serves as a feed screw for moving the moving base 18*a* in the Z direction, while the motor M serves as a drive source for the screw shaft 18*b*. In the Z-direction moving mechanism 18, the drive of the motor M rotates the screw shaft 18*b*, and the rotation of the screw shaft 18*b* moves the moving base 18*a* in the Z direction. Thereby, the Z-direction moving mechanism 18 moves the droplet jetting head H, which is supported by the supporting member 17, in the Z direction.

Refer back to FIG. 1. The head maintenance unit 8 is provided on the upper surface of the base 4, on the extended line of the moving direction of the droplet-jetting-head unit 6, and at a position separated from the Y-direction guide plate 9. The head maintenance unit 8 cleans the droplet jetting head H of the droplet-jetting-head unit 6. Note that the head maintenance unit 8 automatically cleans the droplet jetting head H while the droplet jetting head H stays at a maintenance position that faces the head maintenance unit 8.

Inside the ink supply box 3, a liquid storage unit 21 and a pump unit 22 are provided. The liquid storage unit 21 is an ink tank or the like, and stores ink. The pump unit 22 serves as a flow power source for the ink. The ink in the liquid storage unit 21 is driven by the pump unit 22 so as to be supplied to the droplet jetting head H. Note that various kinds of ink may be used as the ink. For example, the ink is a solution consisting of, for example, a solute which remains as a residue on the substrate K, and a solvent in which the solute is dissolved (dispersed). As such solution, used is, for example, ink that contains water, a water-absorbing solvent with a low vapor pressure (for example, ethylene glycol, abbreviated as "EG"), a water-soluble film material, and the like.

A controller 23 configured to control each unit is provided inside the base 4. The controller 23 includes: a control unit, such as a CPU, that integrally controls those units; and a storage unit that stores, for example, various programs and application information on the application of droplets to the substrate K (all of which are not illustrated). In addition, an input unit (not illustrated) that is manipulated by the operator is connected to the controller 23. Note that the application information is information on the application operations performed on the substrate K, and includes the application pattern, (for example, a dot pattern), the conveyance speed of the substrate K, and the jetting timing.

The controller 23 performs various control operations on the basis of the application information and by using the various programs. Specifically, the controller 23 controls the movement of the Y-direction moving table 10, the movement of the X-direction moving table 11, the movement of the base plate 15, the drive of the support moving mechanism 16, and the like. With this operation of the controller 23, the relative position of the substrate K to the droplet jetting head H on the substrate holding table 12 can be variously changed. Furthermore, the controller 23 controls the drive of the droplet jetting head H and the drive of the pump unit 22 on the basis of the application information and by using the various programs.

For example, on the basis of the application information and by using the various programs, the controller 23 performs the application operation as follows. Specifically, the controller 23 first controls the substrate moving mechanism 5 and the unit moving mechanism 7 so that the droplet jetting head H can be positioned in an application starting position that faces the substrate K. Thereafter, while moving the substrate holding table 12 in the X direction, the controller 23 controls the droplet jetting head H so that droplets can be applied to the substrate K on the substrate holding table 12. At this time, the droplet jetting head H jets droplets to the substrate K which is moved in the X direction, so that the dot-line patterns, each aligned with the Y direction, are sequentially formed in the X direction. As a result, a predetermined application pattern is applied to the substrate K.

Hereinafter, the units involved in the ink circulation of the droplet jetting applicator 1 will be described in detail below.

As shown in FIG. 2, the droplet jetting head H has an inner channel Ha through which ink supplied from the liquid storage unit 21 passes. The droplet jetting head H jets the ink passing through the inner channel Ha through the nozzles N as droplets.

Between the liquid storage unit 21 and the droplet jetting head H, a liquid supply channel 31 is provided. The liquid supply channel 31 connects the liquid storage unit 21 and the inner channel Ha of the droplet jetting head H, and serves as a channel for supplying ink from the liquid storage unit 21 to the droplet jetting head H. As the liquid supply channel 31, a tube, a pipe or the like is used, for example.

In (along) the liquid supply channel 31, a liquid supply unit P1 and a first buffer tank (first buffer liquid reservoir) 19 are provided in this order from the liquid storage unit 21 side. In other words, the liquid supply channel 31 is formed by the first buffer tank 19, a channel 31*a* connecting the liquid storage unit 21 and the first buffer tank 19, and a channel 31*b* connecting the first buffer tank 19 and the droplet jetting head H.

The liquid supply unit P1 is a device configured to supply ink from the liquid storage unit 21 to the droplet jetting head H through the liquid supply channel 31. As the liquid supply unit P1, a pump for liquid, or the like is used, for example. The liquid supply unit P1 is provided in the pump unit 22, and is electrically connected to the controller 23. The drive of the liquid supply unit P1 is controlled by the controller 23.

The first buffer tank 19 is a negative pressure tank to make the liquid pressure of the ink in the droplet jetting head H negative. In the liquid supply channel 31, the first buffer tank 19 is positioned closer to the droplet jetting head H than the liquid supply unit P1, and is formed so that the ink flowing from the channel 31*a* of the liquid supply channel 31 would drop thereinto. The inflow ink is reserved in the first buffer tank 19. Specifically, in the first buffer tank 19, the inflow ink is reserved after flowing along the inner wall surface thereof. Accordingly, even if air bubbles are present in the liquid supply channel 31, the air bubbles are removed at that time. In particular, air bubbles can enter the channel 31*a* of the liquid supply channel 31 during operations such as the exchange of the droplet jetting head H, but such air bubbles are also removed at that time. In this manner, the first buffer tank 19 functions as a bubble remove unit configured to remove air bubbles from the ink having flown through the channel 31*a*. Furthermore, the first buffer tank 19 has an air layer. The air layer functions as a layer that absorbs pressure fluctuation caused by the drives of the liquid supply unit P1 and a second liquid return unit P4.

The first buffer tank 19 is connected to a decompression unit P2 through an air exhaustion pipe 19*a*. The decompression unit P2 is configured to decompress the inside of the tank, and provided in the pump unit 22. In addition, the decompression unit P2 is electrically connected to the controller 23, and the drive thereof is controlled by the controller 23. Moreover, in the path of the air exhaustion pipe 19*a*, provided is a regulator R1 for controlling the pressure of the tank. Note that, as the decompression unit P2, a vacuum pump is used, for example. The decompression unit P2 generates a negative pressure for adjusting the ink level (meniscus) of each nozzle N of the droplet jetting head H. Such an adjustment prevents leakage and jetting failure of the ink.

Furthermore, on the first buffer tank 19, mounted is a liquid level sensor F for detecting the liquid level in the tank. The liquid level sensor F is electrically connected to the controller 23, and when the ink in the first buffer tank 19 becomes not more than a predetermined amount, the liquid level sensor F detects this and sends a detection signal to the controller 23. As the liquid level sensor F, an ultrasonic liquid level meter is used, for example.

Between the droplet jetting head H and the liquid storage unit 21, a first liquid return channel 32 is also provided. The first liquid return channel 32 connects the inner channel Ha of the droplet jetting head H and the liquid storage unit 21, and serves as a channel for returning the ink having passed through the inner channel Ha of the droplet jetting head H, from the droplet jetting head H to the liquid storage unit 21. As the first liquid return channel 32, a tube, a pipe or the like is used, for example.

Along the first liquid return channel 32, a second buffer tank (second buffer liquid reservoir) 20, a first valve V1, and a first liquid return unit P3 are provided in this order from the droplet jetting head H side. In other words, the first liquid return channel 32 is formed by the second buffer tank 20, a channel 32*a* connecting the droplet jetting head H and the second buffer tank 20, and a channel 32*b* connecting the second buffer tank 20 and the liquid storage unit 21.

The first liquid return unit P3 is a device configured to return the ink having passed through the inner channel Ha of the droplet jetting head H, from the droplet jetting head H to the liquid storage unit 21 through the first liquid return channel 32. As the first liquid return unit P3, a pump for liquid, or the like is used, for example. The first liquid return unit P3 is provided in the pump unit 22, and is electrically connected to the controller 23. The drive of the first liquid return unit P3 is controlled by the controller 23. The first valve V1 is an on-off valve to open and close the first liquid return channel 32. The first valve V1 is electrically connected to the controller 23, and the drive of the first valve V1 is controlled by the controller 23.

In the liquid return channel 32, the second buffer tank 20 is positioned closer to the droplet jetting head H than the first liquid return unit P3, and is formed so that the ink flowing from the channel 32*a* of the liquid return channel 32 would drop thereinto. The inflow ink is reserved in the second buffer tank 20. Specifically, in the second buffer tank 20, the inflow ink is reserved after flowing along the inner wall surface thereof. Accordingly, even if air bubbles are present in the liquid return channel 32, the air bubbles are removed at that time. In particular, air bubbles can enter the channel 32*a* of the liquid return channel 32 during operations such as the exchange of the droplet jetting head H, but such air bubbles are also removed at that time. In this manner, the second buffer tank 20 functions as a bubble remove unit configured to remove air bubbles from the ink having flown through the channel 32*a*. Furthermore, the second buffer tank 20 has an air layer. The air layer functions as a layer that absorbs pressure fluctuation caused by the drives of the first and second liquid return units P3 and P4.

The second buffer tank 20 is connected to an air exhaustion pipe 20*a* for releasing air. In the path of the air exhaustion pipe 20*a*, provided is a second valve V2 for opening and closing the air exhaustion pipe 20*a*. The second valve V2 is electrically connected to the controller 23, and the drive thereof is controlled by the controller 23.

In addition, between the droplet jetting head H and the first buffer tank 19, a second liquid return channel 33 is further provided. The second liquid return channel 33 connects the inner channel Ha of the droplet jetting head H and the first buffer tank 19, and serves as a channel for returning the ink having passed through the inner channel Ha of the droplet jetting head H, from the droplet jetting head H to the first buffer tank 19. As the second liquid return channel 33, a tube, a pipe or the like is used, for example.

Along the second liquid return channel 33, the second buffer tank 20, a third valve V3, and the second liquid return unit P4 are provided in this order from the droplet jetting head H side. In other words, the second liquid return channel 33 is formed by the second buffer tank 20, the channel 32*a* connecting the droplet jetting head H and the second buffer tank 20, and a channel 33*a* connecting the second buffer tank 20 and the first buffer tank 19. Note that the channel 32*a* and the second buffer tank 20 are shared with the first liquid return channel 32.

The second liquid return unit P4 is a device configured to return the ink having passed through the inner channel Ha of the droplet jetting head H, from the droplet jetting head H to the first buffer tank 19 through the second liquid return channel 33. As the second liquid return unit P4, a pump for liquid, or the like is used, for example. The second liquid return unit P4 is provided in the pump unit 22, and is electrically connected to the controller 23. The drive of the second liquid return unit P4 is controlled by the controller 23. The third valve V3 is an on-off valve to open and close the second liquid return channel 33. The third valve V3 is electrically connected to the controller 23, and the drive thereof is controlled by the controller 23.

Hereinafter, the ink circulation operation performed by the above-described droplet jetting applicator 1 will be described. The controller 23 of the droplet jetting applicator 1 executes the ink circulation processing by using the various programs. Note that the controller 23 controls the liquid supply unit P1 in response to the detection result from the liquid level sensor F. Specifically, the controller 23 performs control so that more than a predetermined amount of ink would be kept stored in the tank, by supplying ink from the liquid storage unit 21 to the first buffer tank 19.

Figure 3:
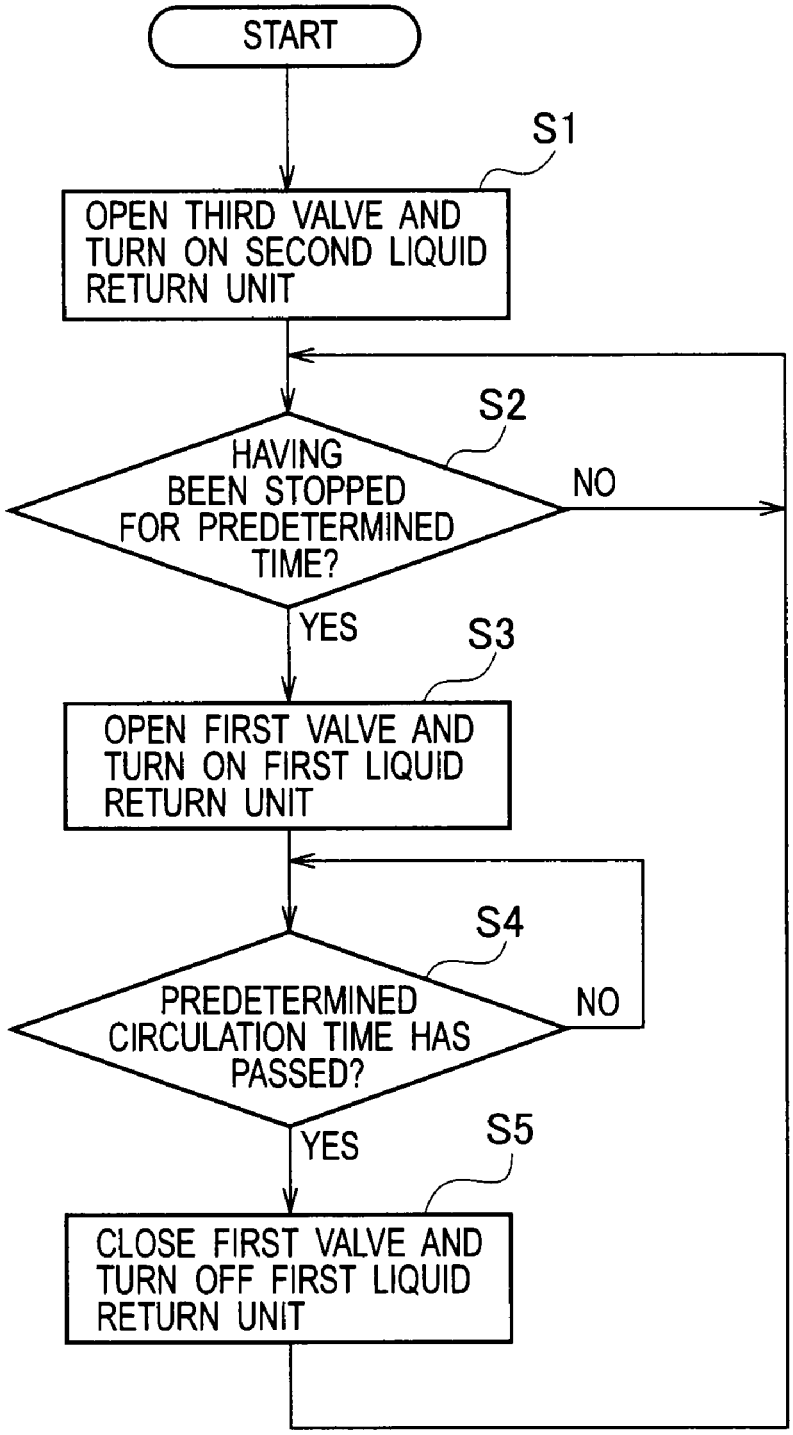
FIG. 3 is a flowchart showing the flow of an ink circulation operation performed by the droplet jetting applicator shown in FIG. 1.

As shown in FIG. 3, in response to the start-up of the droplet jetting applicator 1, the controller 23 opens the valve V3 and turns on the second liquid return unit P4 (step S1). Thereby, the ink in the first buffer tank 19 circulates through the following path (a first circulation channel). Firstly, the ink in the first buffer tank 19 flows into the inner channel Ha of the droplet jetting head H through the channel 31*b*. Then, the ink in the inner channel Ha flows into the second buffer tank 20 through the channel 32*a*. Finally, the ink in the second buffer tank 20 flows into the first buffer tank 19 through the channel 33*a*. The ink always circulates through this first circulation channel (during stand-by state, the application operations, or the like).

Next, the controller 23 determines whether or not the droplet jetting head H has been stopped for a predetermined waiting time, such as 5 or 10 minutes (step S2), so as to stand ready for end of the predetermined waiting time (NO at step S2). The droplet jetting head H is sometimes stopped for the predetermined waiting time, during a tooling change, installation of the substrate K from the device used in the preceding process, or the like.

If the controller 23 determines that the droplet jetting head H has been stopped for the predetermined waiting time (YES at step S2), the controller 23 opens the first valve V1, and turns on the first liquid return unit P3 (step S3). Thereby, the ink circulates through the following path (a second circulation channel) in addition to the first circulation channel. First, the ink in the liquid storage unit 21 flows into the first buffer tank 19 through the channel 31*a*. Then the ink in the first buffer tank 19 flows into the inner channel Ha of the droplet jetting head H through the channel 31*b*. Then, the ink in the inner channel Ha flows into the second buffer tank 20 through the channel 32*a*. Finally, the ink in the second buffer tank 20 flows into the liquid storage unit 21 through the channel 32*b*.

Thereafter, the controller 23 determines whether or not a predetermined circulation time, such as several minutes, has passed (step S4), so as to stand ready for passage of the predetermined circulation time (NO at step S4). If the controller 23 determines that the predetermined circulation time has passed (YES at step S4), the controller 23 closes the first valve V1, and turns off the first liquid return unit P3 (step S5). Then, the step is returned to step S2. Thereby, the ink circulation through the second circulation channel is stopped, while the ink circulation through the first circulation channel is continued.

In this manner, the ink circulates through the first and second circulation channels. Furthermore, the ink always circulates through the first circulation channel. These circulations suppress the settling of a material contained in the ink (material in the ink). As a result, jetting failure of the ink due to the settling of the material in the ink can be prevented in the droplet jetting head H.

In addition, in the first buffer tank 19, the inflow ink is reserved after flowing along the inner wall surface thereof. Accordingly, even if air bubbles are present in the channel 31*a* of the liquid supply channel 31, the air bubbles are removed at that time. Furthermore, the air layer absorbs pressure fluctuation caused by the drives, such as turning-on or turning-off, of the liquid supply unit P1 and the second liquid return unit P4. This configuration makes the pressure fluctuation less likely to be transmitted to the droplet jetting head H through the ink in the channels. Thus, leakage of the ink, absorption of air, and the like can be prevented from being caused by the pressure fluctuation.

In addition, in the second buffer tank 20 as well, the inflow ink is reserved after flowing along the inner wall surface thereof. Accordingly, even if air bubbles are present in the channel 32*a* of the liquid return channel 32, the air bubbles are removed at that time. Furthermore, the air layer absorbs the pressure fluctuation caused by the drives, such as turning-on or turning-off, of the first and second liquid return units P3 and P4. This configuration makes the pressure fluctuation less likely to be transmitted to the droplet jetting head H through the ink in the channels. Thus, leakage of the ink, absorption of air, and the like can be prevented from being caused by the pressure fluctuation.

As described above, the droplet jetting applicator 1 according to the first embodiment of the present invention has the following characteristics. Firstly, the first buffer tank 19 is positioned closer to the droplet jetting head H than the liquid supply unit P1, in the liquid supply channel 31. In addition, the first buffer tank 19 is formed so that the ink flowing from the channel 31*a* of the liquid supply channel 31 would drop thereinto. Moreover, the second buffer tank 20 is positioned closer to the droplet jetting head H than the liquid return units P3 and P4, in the liquid return channels 32 and 33, respectively. In addition, the second buffer tank 20 is formed so that the ink flowing from the channel 32*a* of the liquid return channels 32 and 33 would drop thereinto. Accordingly, the air layers of the first and second buffer tanks 19 and 20 absorb the pressure fluctuation caused by the drives of the liquid supply unit P1 and the liquid return units P3 and P4. Thus, the leakage of the ink, the absorption of the air, and the like can be prevented from being caused by the pressure fluctuation. Secondly, the ink circulates through the internal channel Ha of the droplet jetting head H, the liquid supply channel 31, and the first and second liquid return channels 32 and 33. These circulations suppress the settling of the material contained in the ink. With these characteristics, the droplet jetting applicator 1 can prevent jetting failure of the ink due to the settling of the material in the ink. Moreover, the droplet jetting applicator 1 can also prevent jetting failure due to both exudation of the ink and absorption of air bubbles.

Furthermore, the first and second buffer tanks 19 and 20 function as the bubble remove units, so that air bubbles are removed from the ink. Accordingly, jetting failure of the ink due to the air bubbles in the ink can be prevented from occurring. In particular, this configuration makes it possible to remove air bubbles having entered the channels 31*a* and 32*a* and the inner channel Ha of the droplet jetting head H during operations such as the exchange of the droplet jetting head H.

Specifically, in the first buffer tank 19, the inflow ink from the channel 31*a* of the liquid supply channel 31 is reserved after flowing along the inner wall surface of the first buffer tank 19. Similarly, in the second buffer tank 20, the inflow ink from the channel 32*a* of the liquid return channel 32 is reserved after flowing along the inner wall surface of the second buffer tank 20. As described above, particularly with such a simple configuration, the air bubbles can be surely removed from the ink. In addition, the absorption of the air from openings of the channels 31*a* and 32*a*, and the like can also be prevented.

Moreover, by using the above-described droplet jetting applicator 1 that jets to apply droplets to the substrate K that is an application target, various kinds of coated bodies, such as color filters and black matrices (frames of color filters), can be manufactured without suffering from jetting failure. Accordingly, the use of the droplet jetting applicator 1 can prevent the manufacturing failure of coated bodies, and thereby makes it possible to obtain highly reliable coated bodies.

Second Embodiment

A second embodiment of the present invention will be described by referring to FIGS. 4 to 6.

The second embodiment of the present invention is a modification of the first embodiment. Accordingly, description will be given particularly of parts different from the first embodiment, that is, of units involved in an ink circulation and an ink circulation operation itself of a droplet jetting applicator 1. Note that, in the second embodiment, the same parts as those have been described in the first embodiment will not be described.

Figure 4:
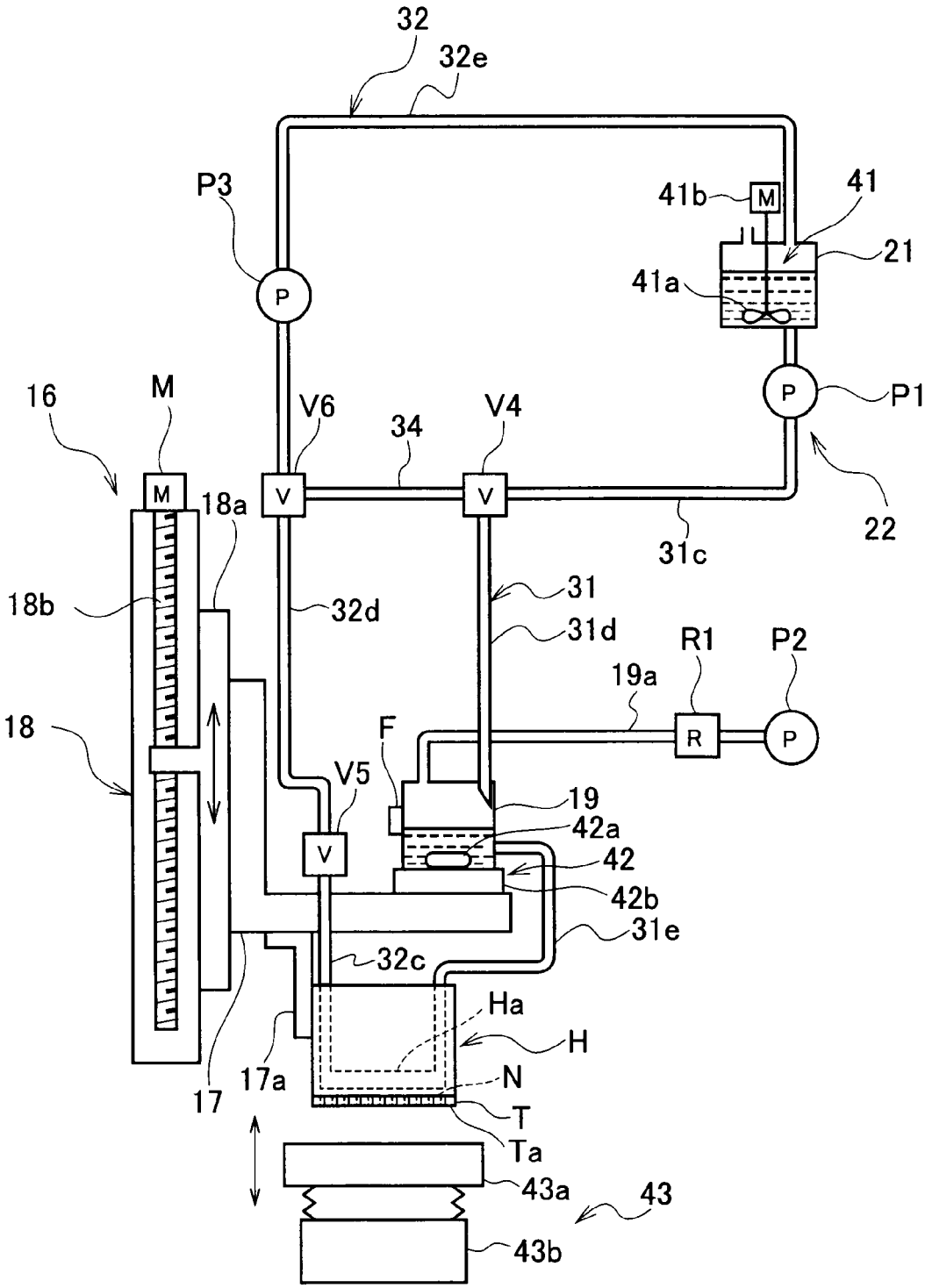
FIG. 4 is a schematic view showing an outline configuration of units involved in ink circulation of a droplet jetting applicator according to a second embodiment of the present invention.

In a droplet jetting applicator 1 according to the second embodiment of the present invention, as shown in FIG. 4, along a liquid supply channel 31, a liquid supply unit P1, a fourth valve V4, and a first buffer tank (first buffer liquid reservoir) 19 are provided in this order from a liquid storage unit 21 side. In other words, the liquid supply channel 31 is formed by the first buffer tank 19, a channel 31*c* connecting the liquid storage unit 21 and the fourth valve V4, a channel 31*d* connecting the fourth valve V4 and the first buffer tank 19, a channel 31*e* connecting the first buffer tank 19 and a droplet jetting head H. As each of the channels 31*c* to 31*e*, a tube, a pipe or the like is used, for example.

Here, as such ink, ink containing spacer particles is used, for example. When the ink is applied to and dried on a substrate, the spacer particles remain as residues on the substrate. The spacer particles are rigid bodies each having a diameter of several microns, and used to create uniform space between two substrates for the manufacture of a liquid crystal display so that a liquid crystal can be implanted into the two substrates. The spacer particles are formed of a resin or the like, and the specific gravity and diameter of each particle are larger than those of a pigment used for coloring. Thus, the spacer particles are more likely to settle down in the ink.

The liquid storage unit 21 includes a first stirring mechanism 41 configured to stir liquid in the liquid storage unit 21. The first stirring mechanism 41 includes a propeller 41*a* and a motor 41*b*. The propeller 41*a* is rotatably mounted in the liquid storage unit 21 to serve as a stirring member. The motor 41 serves as a drive source to rotate the propeller 41*a*. The motor 41*b* is electrically connected to a controller 23, and the drive thereof is controlled by the controller 23. In the first stirring mechanism 41, in response to a control performed by the controller 23, the motor 41*b* is driven to rotate the propeller 41*a*, which is soaked in the liquid in the liquid storage unit 21. Accordingly, the propeller 41*a* is made to stir the liquid.

The first buffer tank 19 includes a second stirring mechanism 42 configured to stir liquid in the first buffer tank 19. The second stirring mechanism 42 includes a rotator (stirring element) 42*a* and a stirring base 42*b*. The rotator 42*a* is rotatably mounted on the bottom in the first buffer tank 19 to serve as a stirring member. The stirring base 42*b* rotates the rotator 42*a*. For example, the rotator 42*a* is a permanent magnet rotator in the shape of a rod, and the stirring base 42*b* is a stirrer to rotate the rotator 42*a* with rotational magnetic force. The stirring base 42*b* is provided on a supporting member 17, and the first buffer tank 19 is further provided on the stirring base 42*b*. The stirring base 42*b* is electrically connected to the controller 23, and the drive thereof is controlled by the controller 23. In the second stirring mechanism 42, in response to a control performed by the controller 23, the stirring base 42*b* is driven to rotate the rotator 42*a*, which is soaked on the bottom in the first buffer tank 19. Accordingly, the rotator 42*a* is made to stir the liquid in the first buffer tank 19.

The first buffer tank 19 functions as a negative pressure tank to make the liquid pressure of the ink in the droplet jetting head H negative. In addition, it also functions as a positive pressure tank to make the liquid pressure of the ink in the droplet jetting head H positive. The first buffer tank 19 is connected to a decompression unit P2 through an air exhaustion pipe 19*a*, and functions as both a decompressor and a pressurizer (pressurizing unit). When the decompression unit P2 functions as a pressurizer, it pressurizes the inside of the tank in accordance with pressure regulation of a regulator R1. Accordingly, when needed (for example when pressure purge is performed, or the like), the inside of the first buffer tank 19 is pressurized in accordance with the pressure regulation of the regulator R1 so that the ink can be extruded and thus discharged from the nozzles of the droplet jetting head H. Note that the first buffer tank 19 may be connected to a negative pressure adjustment tank in place of the regulator R1 and the decompression unit P2.

Along the first liquid return channel 32, a fifth valve V5, a sixth valve V6, and a first liquid return unit P3 are provided in this order from the droplet jetting head H side. In other words, the first liquid return channel 32 is formed by a channel 32*c* connecting the droplet jetting head H and the fifth valve V5, a channel 32*d* connecting the fifth valve V5 and the sixth valve V6, and a channel 32*e* connecting the sixth valve V6 and the liquid storage unit 21. In addition, between the fourth valve V4 and the sixth valve V6, a channel 34 connecting them is provided. As each of the channels 32*c* to 32*e*, a tube, a pipe or the like is used, for example.

Here, each of the fourth and sixth valves V4 and V6 is a cross valve serving as a switching valve for switching the channel. These fourth and sixth valves V4 and V6 are electrically connected to the controller 23, and the drives thereof are controlled by the controller 23. Moreover, the fifth valve V5 is an on-off valve to open and close the first liquid return channel 32. The fifth valve V5 is also electrically connected to the controller 23, and the drive thereof is controlled by the controller 23. As each of the fourth to sixth valves V4 to V6, a magnetic valve is used, for example.

A head maintenance unit 8 (see, FIG. 1) includes a liquid vessel unit 46 for storing liquid such as ink or solvent. The liquid vessel unit 43 includes a liquid vessel 43*a* and a liquid vessel moving mechanism 43*b*. The liquid vessel 43*a* stores liquid such as ink or solvent, while the liquid vessel moving mechanism 43*b* moves the liquid vessel 43*a* in the Z direction. The liquid vessel moving mechanism 43*b* is electrically connected to the controller 23, and the drive thereof is controlled by the controller 23. In the liquid vessel unit 43, the liquid moving mechanism 43 moves the liquid vessel 43*a* closer to the droplet jetting head H that stops at the maintenance position. Then, a nozzle surface Ta of the droplet jetting head H is soaked in the liquid in the liquid vessel 43*a*. Note that although the liquid vessel moving mechanism 43*b* is used here, the present invention is not limited to this. For example, the Z-direction moving mechanism 18 may move the droplet jetting head H closer to the liquid vessel 43*a* so that the nozzle surface Ta of the droplet jetting head H would be soaked in the liquid in the liquid vessel 43*a*.

Hereinafter, the ink circulation operation performed by the above-described droplet jetting applicator 1 will be described. The controller 23 of the droplet jetting applicator 1 executes the ink circulation processing by using various programs. The ink circulation operation is executed at any timing. For example, such timing may be the timing when the droplet jetting applicator 1 has been idle for a predetermined time, a timing selected by the operator, or the like. For example, the ink circulation operation is performed when the operator presses down a start button of an input unit, or the like. Note that during a normal operation, the controller 23 controls the liquid supply unit P1 in response to the detection result from the liquid level sensor F. Specifically, the controller 23 performs control so that more than a predetermined amount of ink would be kept stored in the tank by supplying ink from the liquid storage unit 21 to the first buffer tank 19. This ink supply operation is performed while the forth valve V4 is controlled so that the channels 31*c* and 31*d* can be connected, and that thereby the liquid storage unit 21 and the first buffer tank 19 are connected.

Figure 5:
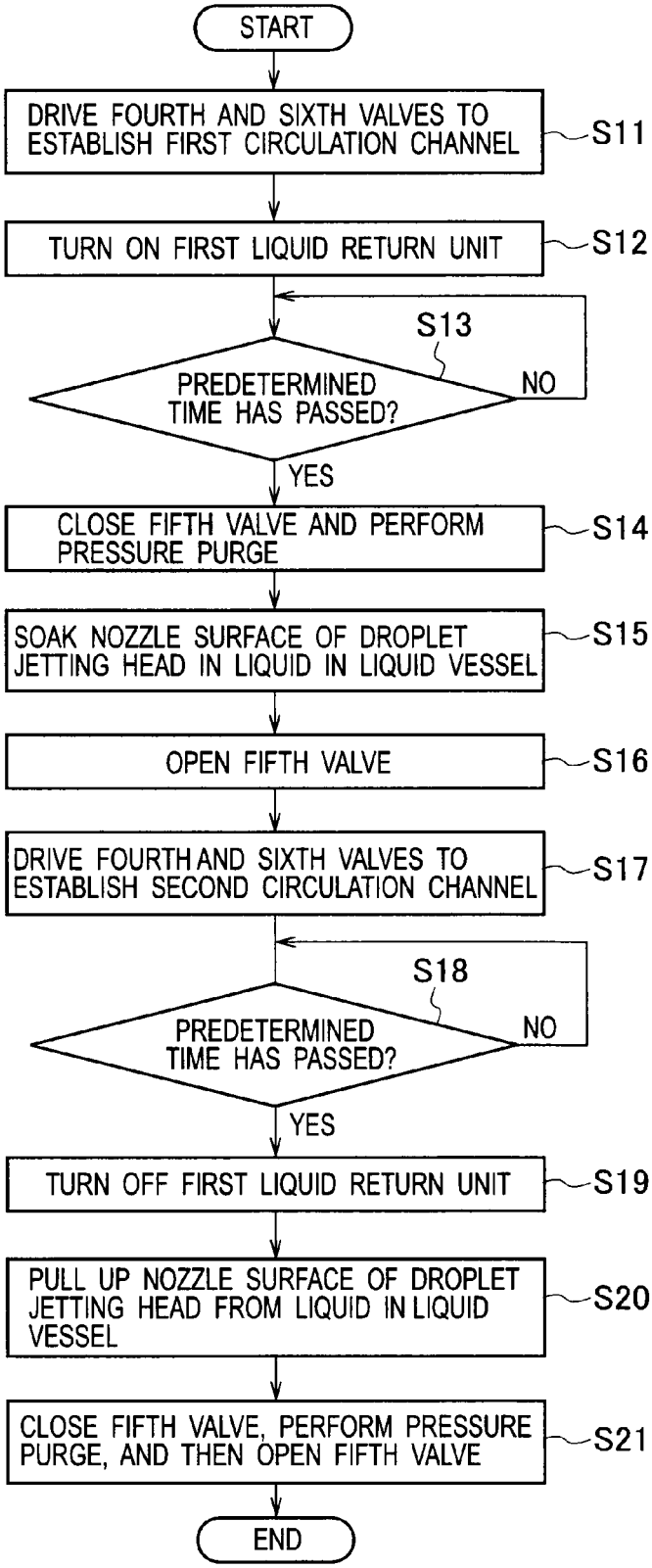
FIG. 5 is a flowchart showing the flow of an ink circulation operation performed by the droplet jetting applicator having the units involved in the ink circulation shown in FIG. 4.
Figure 6:
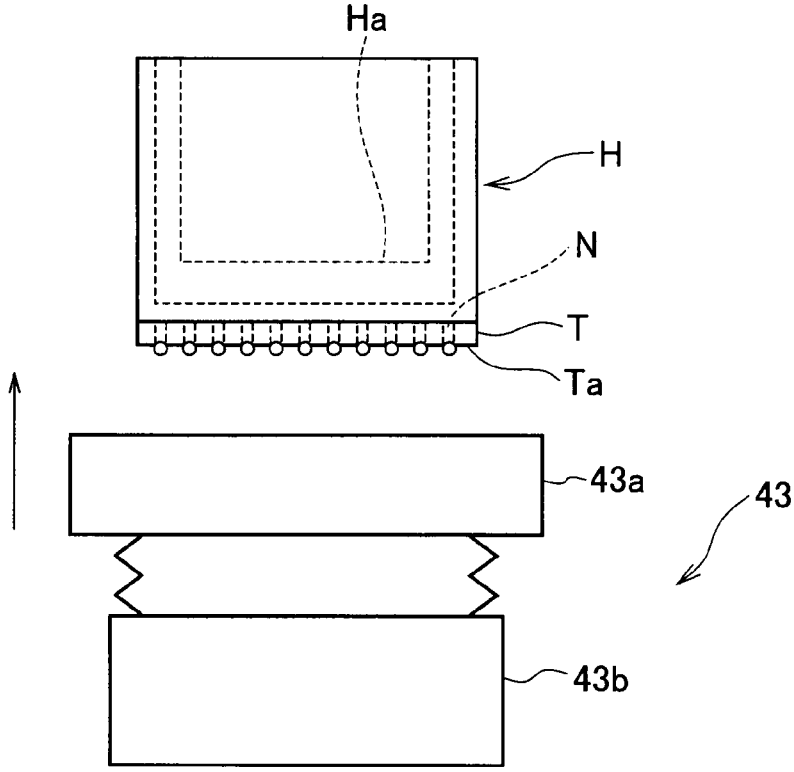
FIG. 6 is a view for illustrating pressure purge in the flow of the ink circulation operation shown in FIG. 5.

As shown in FIG. 5, the controller 23 drives the fourth and sixth valves V4 and V6 at any timing so that the channels 31*c*, 34 and 32*e* can be connected, and that thereby a first circulation channel is established (step S11). At the same time, the controller 23 turns on the first liquid return unit P3 (step S12). Thereafter, the controller 23 determines whether or not a predetermined time (for example, several minutes) has passed (step S13), so as to stand ready for passage of the predetermined time (NO at step S13). Thereby, the ink in the liquid storage unit 21 circulates through the first circulation channel and back to the liquid storage unit 21. This ink circulation is performed for the predetermined time, thus preventing a material (such as particles) contained in the liquid from settling down in the first circulation channel.

If the controller 23 determines that the predetermined time has passed (YES at step S13), the controller 23 closes the fifth valve V5 and performs the pressure purge (see, FIG. 6) (step S14). The pressure purge is an operation to cause a spherical drop to adhere onto the tip of each nozzle N of the droplet jetting head H that stops at the maintenance position. After performing the pressure purge, the controller 23 performs control such that the nozzle surface Ta of the droplet jetting head H with the drops adhered thereto is soaked in the liquid in the liquid vessel 43*a* (step S15), and then opens the fifth valve V5 (step S16).

Specifically, the controller 23 performs circulation preparation control to prepare for the ink circulation as follows. In the circulation preparation control, the fifth valve V5 is firstly closed, and the pressure purge (pressurization) is performed on the first buffer tank 19 so as to pressurize the inner channel Ha of the droplet jetting head H, while the fifth valve V5 is closed. Consequently, as shown in FIG. 6, the liquid in the inner channel Ha of the droplet jetting head H is discharged from the nozzles N, and is caused to adhere onto the tip of each nozzle N as a spherical drop. Secondly, the liquid vessel moving mechanism 43*b* is caused to soak, in the liquid in the liquid vessel 43*a*, the nozzle surface Ta of the droplet jetting head H with the drops adhered thereto, and the fifth valve V5 is opened while the nozzle surface Ta of the droplet jetting head H is soaked in the liquid in the liquid vessel 43*a*. Note that pressure used for the pressure purge is set to such a level as to force the liquid in the inner channel Ha of the droplet jetting head H to be discharged from each of the nozzles N, and as to force the thus-discharged ink to adhere onto the tip of each nozzle N as a spherical drop.

During a normal operation, a negative pressure is applied to the liquid level of the ink on the tip of each nozzle N in order to prevent the leakage of the ink, and the like. At the same time, this negative pressure dents the liquid level (meniscus) of the ink of each nozzle N inward. Accordingly, if the nozzle surface Ta of the droplet jetting head H is soaked in the liquid in the liquid vessel 43*a* with this state, air bubbles are generated on the tips of the nozzles N, and thereafter enter the droplet jetting head H through the nozzles N. To prevent this phenomenon, the nozzle surface Ta of the droplet jetting head H is soaked in the liquid in the liquid vessel 43*a*, after a spherical drop is adhered on the tip of each nozzle N. With the spherical drop adhered on the tip of each nozzle N, the liquid level of the ink on the tip of each nozzle N is bowed outward. Thereby, air bubbles are prevented from being generated when the nozzle surface Ta of the droplet jetting head H is soaked in the liquid in the liquid vessel 43*a*.

In addition, the pressure fluctuation caused by the drives of the valves and pumps is generally transmitted to the droplet jetting head H through the ink in the channels. However, since the nozzle surface Ta of the droplet jetting head H is soaked in the liquid in the liquid vessel 43*a* before the ink circulation operation, even if the ink leaks from the nozzles N of the droplet jetting head H due to the pressure fluctuation, the leaked ink is stored in the liquid vessel 43*a*. Moreover, the circulation preparation also prevents the absorption of the air from the nozzles N, or the like. In addition, inclusion of air bubbles through the nozzles N due to the pulsation of the ink circulation is also prevented. Furthermore, the fifth valve V5 is closed before the pressure purge is performed. This makes it possible to evenly apply pressure to all of the nozzles N, so that the ink can be stably extruded from the nozzles N during the pressure purge.

Next, the controller 23 drives the fourth and sixth valves V4 and V6 so that the channels 31*c* and 31*d* as well as the channels 32*d* and 32*e* can be connected, and that thereby a second circulation channel is established (step S17). Thereafter, the controller 23 determines whether or not a predetermined time (for example, several minutes) has passed (step S18), so as to stand ready for passage of the predetermined time (NO at step S18). Thereby, the ink in the liquid storage unit 21 circulates through the second circulation channel and back to the liquid storage unit 21. This ink circulation is performed for the predetermined time, thus preventing a material (such as particles) contained in the liquid from settling down in the second circulation channel. During this ink circulation, the liquid in the first buffer tank 19 is decreased. However, in response to the detection result from the liquid level sensor F, the liquid supply unit P1 is driven to supply ink from the liquid storage unit 21 to the first buffer tank 19 so that more than a predetermined amount of ink would be kept stored in the first buffer tank 19.

If the controller 23 determines that the predetermined time has passed (YES at step S18), the controller 23 turns off the first liquid return unit P3 (step S19), and pulls up the nozzle surface Ta of the droplet jetting head H from the liquid in the liquid vessel 43*a* (step S20). Thereafter, the controller 23 closes the fifth valve V5 to perform the pressure purge again for a predetermined time. Finally, the controller 23 opens the fifth valve V5 (step S11). After that, the head maintenance unit 8 cleans the nozzle surface Ta of the droplet jetting head H, so that the droplet jetting head H stands ready for the application operation. Note that, when the first liquid return unit P3 is turned off, it is determined that the ink circulation operation is stopped.

More specifically, if the ink circulation is stopped, the controller 23 performs circulation completion control. In the circulation completion control, the liquid vessel moving mechanism 43*b* is firstly caused to pull up the nozzle surface Ta of the droplet jetting head H from the liquid in the liquid vessel 43*a*. Secondly, the fifth valve V5 is closed, and the pressure purge (pressurization) is performed on the first buffer tank 19 so as to pressurize the inner channel Ha of the droplet jetting head, while the fifth valve V5 is closed. Consequently, the liquid in the inner channel Ha of the droplet jetting head H is extruded and thus discharged from the nozzles N. Finally, the fifth valve V5 is opened and the head maintenance unit 8 is caused to clean the nozzle surface Ta of the droplet jetting head H.

Since the ink flow generally stagnates near the nozzles N during the ink circulation, the material (such as particles) contained in the liquid settles down around here. To prevent this phenomenon, pressure purge for ink extrusion is performed to extrude the ink from the nozzles N when the pump stops sending the liquid, that is, when the ink circulation is completed. This ink extrusion causes the liquid in the inner channel Ha of the droplet jetting head H to flow down to be discharged from each nozzle N. Thus, the material (such as particles) contained in the liquid can be prevented from settling down near the nozzles N.

In addition to the aforementioned ink circulation, the controller 23 also drives the first and second stirring mechanisms 41 and 42 in response to the start-up of the droplet jetting applicator 1, thereby stirring the liquid in both the liquid storage unit 21 and the first buffer tank 19. Accordingly, the liquid in both the liquid storage unit 21 and the first buffer tank 19 is always stirred, so that the settling of the material (such as particles) contained in the liquid is suppressed. Thus, jetting failure due to such settling can be prevented.

As described above, the droplet jetting applicator 1 according to the second embodiment of the present invention has the following characteristics. Firstly, as the preparation for the ink circulation, the nozzle surface Ta of the droplet jetting head H is soaked in the liquid in the liquid vessel 43*a* before the ink circulation operation. Specifically, while the fifth valve V5 is closed, the pressure purge (pressurization) is first performed. Accordingly, the liquid in the inner channel Ha of the droplet jetting head H is discharged from each of the nozzles N, and is caused to adhere onto the tip of each nozzle N, as a spherical drop (see, FIG. 6). Then, the liquid vessel moving mechanism 43*b* soaks, in the liquid vessel 43*a*, the nozzle surface Ta of the droplet jetting head H with the drops adhered thereto. Since the nozzle surface Ta of the droplet jetting head H is soaked in the liquid in the liquid vessel 43*a* before the ink circulation operation as described above, even if the ink leaks from the nozzles N of the droplet jetting head H due to the pressure fluctuation, the leaked ink is stored in the liquid vessel 43*a*. Moreover, this circulation preparation also prevents the absorption of the air from the nozzles N. Secondly, the ink circulates through the first and second circulation channels. These circulations suppress the settling of the material (such as particles) contained in the ink. In addition, inclusion of air bubbles through the nozzles N due to the pulsation of the ink circulation is also prevented. With these characteristics, the droplet jetting applicator 1 can prevent the jetting failure of the ink due to the settling of the material in the ink. Moreover, the droplet jetting applicator 1 can also prevent jetting failure due to both exudation of the ink and absorption of air bubble.

In particular, the nozzle surface Ta of the droplet jetting head H is soaked in the liquid in the liquid vessel 43*a*, after a spherical drop is adhered on the tip of each nozzle N. With the spherical drop adhered on the tip of each nozzle N, the liquid level of the ink on the tip of each nozzle N is bowed outward. Thereby, air bubbles are prevented from being generated when the nozzle surface Ta of the droplet jetting head H is soaked in the liquid in the liquid vessel 43*a*. This surely prevents the jetting failure due to the absorption of air bubbles.

Furthermore, when the ink circulation is stopped, the pressure purge (pressurization) is performed while the fifth valve V5 is closed. Accordingly, the liquid in the inner channel Ha of the droplet jetting head H is discharged from the nozzles N. Thereby, the ink that stagnates near the nozzles N during the ink circulation is extruded from the nozzles N. This ink extrusion prevents the settling of the material (such as particles) due to the ink stagnation near the nozzles N. Accordingly, the concentration of the material in the ink is kept constant. As a result, the jetting failure caused by the settling of the material in the ink near the nozzles N can be surely prevented.

Moreover, in the droplet jetting applicator 1 according to the second embodiment, further provided are the first stirring mechanism 41 configured to stir the liquid in the liquid storage unit 21, and the second stirring mechanism 42 configured to stir the liquid in the first buffer tank 19. Accordingly the liquid in both the storage unit 21 and the first buffer tank 19 is always stirred, so that settling of the material (such as particles) contained in the liquid is suppressed. Thus, the jetting failure due to such settling can be surely prevented. Note that the first and second stirring mechanisms 41 and 42 can be employed in the first embodiment. Furthermore, any one of the first and second stirring mechanisms 41 and 42 may be provided in the second buffer tank 20 of the first embodiment.

Furthermore, similar to the above-described first embodiment, the first buffer tank 19 functions as a bubble remove unit, so that air bubbles are removed from the ink. Accordingly, jetting failure of the ink due to the air bubbles in the ink can be prevented. In particular, this configuration makes it possible to remove air bubbles having entered the channel 31*d* during operations such as the exchange of the droplet jetting head H. Specifically, in the first buffer tank 19, the inflow ink from the channel 31*d* of the liquid supply channel 31 is reserved after flowing along the inner wall surface of the first buffer tank 19. As described above, particularly with such a simple configuration, the air bubbles can be surely removed from the ink. In addition, the absorption of the air from an opening of the channel 31*d*, and the like can also be prevented.

Moreover, the use of the above-described droplet jetting applicator 1 that jets to apply droplets to the substrate K that is an application target makes it possible to manufacture coated bodies each having a substrate on which spherical spacers are applied and which has, for example, a color filter or the like without suffering from jetting failure. Accordingly, the use of the droplet jetting applicator 1 can prevent the manufacturing failure of coated bodies, and thereby makes it possible to obtain highly reliable coated bodies.

Third Embodiment

A third embodiment of the present invention will be described by referring to FIG. 7.

The third embodiment of the present invention is a modification of the first embodiment. Accordingly, description will be given particularly of a part different from the first embodiment, that is, of a discharging mechanism 51. Note that, in the third embodiment, the same parts as those have been described in the first embodiment will not be described.

Figure 7:
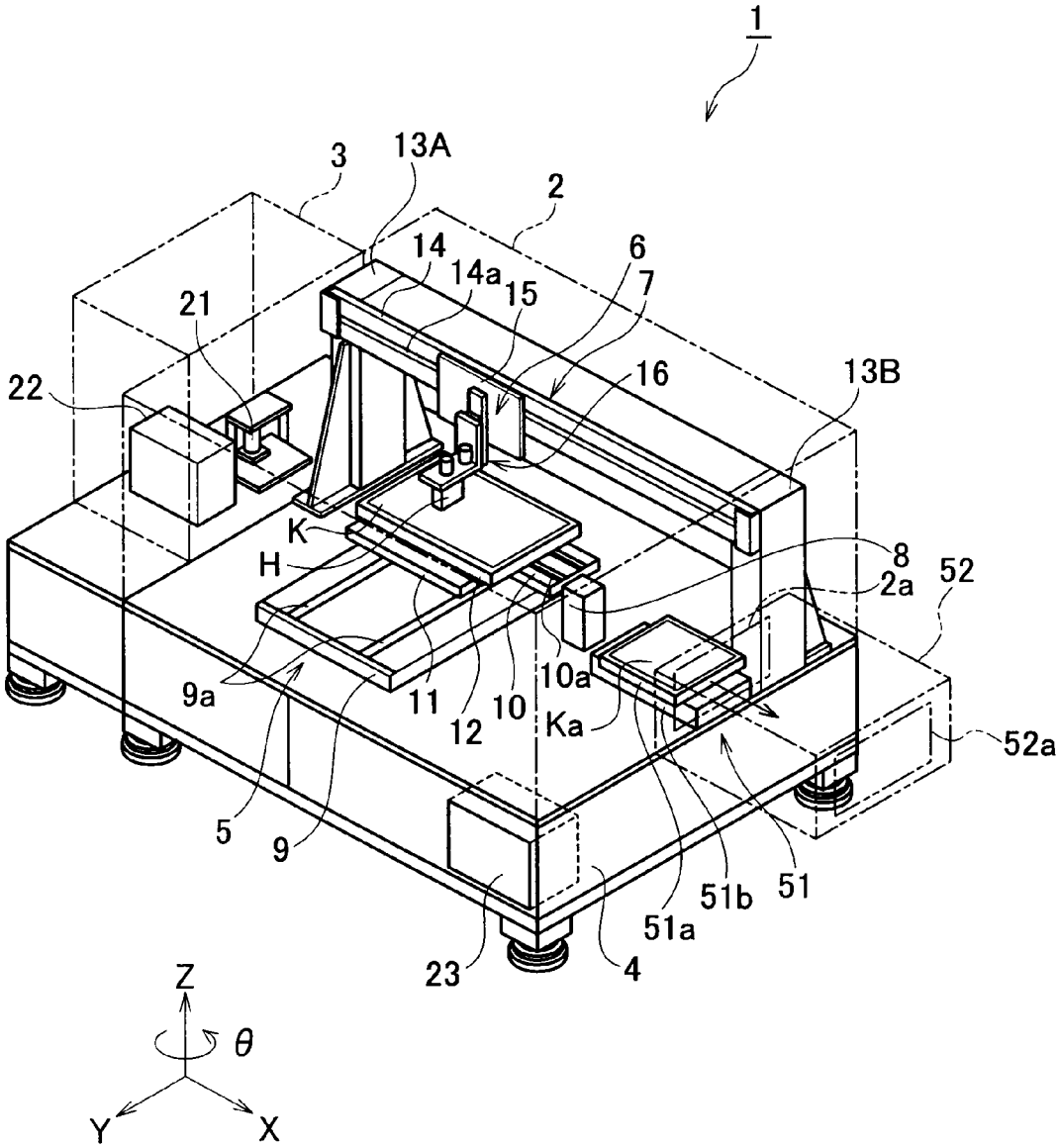
FIG. 7 is a perspective view showing an outline configuration of a droplet jetting applicator according to a third embodiment of the present invention.

As shown in FIG. 7, a droplet jetting applicator 1 according to the third embodiment of the present invention includes a discharging mechanism 51 in an ink application box 2. The discharging mechanism 51 is configured to discharge, to the outside, a sample application substrate (a target for sample application) Ka after sample application (sample jetting). The droplet jetting head H performs the sample application to apply droplets onto the sample application substrate Ka. The sample application substrate Ka discharged by the discharging mechanism 51 is received by a sample output box 52 configured to output the sample application substrate Ka.

The discharging mechanism 51 includes a stage 51*a* and a discharge moving mechanism 51*b*. On the stage 51*a*, the sample application substrate Ka is mounted. The discharge moving mechanism 51*b* moves the stage 51*a* in the X direction to the outside of the ink application box 2 through a shutter 2*a*, so as to discharge the sample application substrate Ka onto the stage 51*a*. Here, the shutter 2*a* is provided in the ink application box 2 so as to be openable and closable. Note that, as the discharge moving mechanism 51*b*, a feed screw mechanism, a linear motor mechanism or the like is used, for example.

The sample output box 52 has a structure capable of receiving both the sample application substrate Ka discharged through the shutter 2*a* of the ink application box 2 and the stage 51*a*, and has an openable and closable shutter 52*a*. The inner atmosphere of the sample output box 52 is maintained in the same conditions (such as temperature and humidity) as the inner atmosphere of the ink application box 2. At the time of the discharge of the sample application substrate Ka, the shutter 2*a* of the ink application box 2 is opened, and thereafter the discharging mechanism 51 discharges the sample application substrate Ka from the ink application box 2 to the sample output box 52. At this time, even though the shutter 2*a* of the ink application box 2 is opened, the airtightness of the ink application box 2 and the sample output box 52 is maintained. The use of such sample output box 52 makes it possible to suppress fluctuation of the inner atmosphere of the ink application box 2 caused by the discharge of the sample application substrate Ka, that is, by the opening or closing of the shutter 2*a* of the ink application box 2.

Here, as such ink, ink containing spacer particles is used, for example. When the ink is applied to and dried on the substrate, the spacer particles remain as residues on the substrate. The spacer particles are rigid bodies each having a diameter of several microns, and used to create uniform space between two substrates for the manufacture of a liquid crystal display so that a liquid crystal can be implanted into the two substrates. The spacer particles are formed of a resin or the like, and the specific gravity and diameter of each particle are larger than those of a pigment used for coloring. Thus, the spacer particles are more likely to settle down in the ink.

In the above-described droplet jetting applicator 1, the droplet jetting head H moves to a position facing the sample application substrate Ka on the stage 51*a* of the discharging mechanism 51, and then performs sample application to apply droplets to the sample application substrate Ka. This sample application is performed both before real application (production application) and when needed, for example, at every predetermined time, at the completion of the production application, or the like. After the sample application, the shutter 2*a* of the ink application box 2 is opened. Then, the stage 51*a* is moved to the outside of the ink application box 2, that is, to the inside of the sample output box 52. In this manner, the sample application substrate Ka on the stage 51*a* is discharged into the sample output box 52. Thereafter, the shutter 2*a* of the ink application box 2 is closed. Finally, the shutter 52*a* of the sample output box 52 is opened, and an operator, a robot or the like takes the sample application substrate Ka from the sample output box 52 to an inspection device. In this inspection device, the sample application substrate Ka is inspected. At this time, for example, the landing position and landing area of each droplet are checked. In particular, in the case where the ink containing spacer particles is used, a spacer count check is performed after the sample application substrate Ka with the droplets applied thereto is dried with a dryer. The spacer count check is performed, for example, to check whether or not a predetermined number of spacer particles are present in a predetermined area (predetermined landing area). If the result of the spacer count check is acceptable, the droplet jetting applicator 1 performs the production application.

As have been described so far, the droplet jetting applicator 1 according to the third embodiment of the present invention can provide the same effects as those of the first embodiment. Furthermore, since the droplet jetting applicator 1 according to the third embodiment includes the discharging mechanism 51, the sample application substrate Ka can be discharged to the outside of the device when needed. Thus, application inspection using the sample application substrate Ka can be performed as needed. In particular, in the case where the ink containing spacer particles is used, the spacer count check can be performed after the sample application substrate Ka with the droplets applied thereto is dried with a dryer. This makes it possible to accurately perform the spacer count check. In general, it is difficult to optically check the number of spacers contained in droplets before the droplets are completely dried, because refractive index difference and reflectivity difference between spacers and solvent are extremely small.

Other Embodiment

It should be noted that the present invention is not limited to the above-described embodiments, and various modification may be made without departing from the scope of the present invention.

For example, in the above-described embodiments, a filter for removing impurities and the like is not provided in each of the liquid supply channel 31 and the first and second liquid return channels 32 and 33. However, the present invention is not limited thereto. Such a filter may be provided in each of those channels. In addition, a degasifier configured to remove dissolved gas from the ink may be provided in the liquid supply channel 31 and the first and second liquid return channels 32 and 33.

Furthermore, in the above-described embodiments, the third valve V3 is normally opened while the second liquid return unit P4 is normally turned on. However, the present invention is not limited thereto. For example, at every predetermined timing or the like, the third valve V3 may be opened while the second liquid return unit P4 is turned on. Moreover, the first valve V1 may be normally opened while the first liquid return unit P3 is normally turned on.

In addition, in the above-described embodiments, the substrate K is moved relative to the droplet jetting head H during the application operation. However, the present invention is not limited thereto. Alternatively, the droplet jetting head H may be moved relative to the substrate K. What is needed here is only that the droplet jetting head H and the substrate be moved relative to each other.

Moreover, although, in the above-described embodiments, only one droplet jetting head H is provided, the present invention is not limited thereto. Multiple droplet jetting heads H may be provided, and there is no limitation on the number of droplet jetting heads H.

Finally, although, in the above-described embodiments, various numerical values are used, these values are mere examples, thus not limiting the present invention.

What is claimed is:

1. A droplet jetting applicator, comprising:

a liquid storage unit configured to store liquid;

a droplet jetting head having an inner channel through which the liquid supplied from the liquid storage unit passes, the droplet jetting head configured to jet, as a droplet, the liquid passing through the inner channel;

a liquid supply channel configured to connect the liquid storage unit and the inner channel of the droplet jetting head so as to supply the liquid from the liquid storage unit to the droplet jetting head;

a liquid supply unit provided in the liquid supply channel, and configured to supply the liquid from the liquid storage unit to the droplet jetting head through the liquid supply channel;

a first buffer liquid reservoir provided in the liquid supply channel so as to be positioned closer to the droplet jetting head than the liquid supply unit, and formed so that the liquid flowing from the liquid supply channel drops thereinto and thereafter is reserved therein;

a decompression unit configured to decompress the inside of the first buffer liquid reservoir;

a liquid return channel configured to connect the inner channel of the droplet jetting head and one of the liquid storage unit and the first buffer liquid reservoir so as to return the liquid having passed through the inner channel of the droplet jetting head from the liquid jetting head to the one of the liquid storage unit and the first buffer liquid reservoir;

a liquid return unit provided in the liquid return channel, and configured to return the liquid having passed through the inner channel of the droplet jetting head from the liquid jetting head to one of the liquid storage unit and the first buffer liquid reservoir through the liquid return channel; and a second buffer liquid reservoir provided in the liquid return channel so as to be positioned closer to the droplet jetting head than the liquid return unit, and formed so that the liquid flowing from the liquid return channel drops thereinto and thereafter is reserved therein, wherein the first buffer liquid reservoir allows the liquid flowing from the liquid supply channel to flow along an inner wall surface thereof thereby to remove any bubbles in the liquid flowing from the liquid supply channel, and stores the liquid having flown along the inner wall surface therein, and the second buffer liquid reservoir allows the liquid flowing from the liquid return channel to flow along an inner wall surface thereof thereby to remove any bubbles in the liquid flowing from the liquid supply channel, and stores the liquid having flown along the inner wall surface therein.

2. The droplet jetting applicator according to claim 1, further comprising:

a first stirring mechanism configured to stir the liquid in the liquid storage unit; and a second stirring mechanism configured to stir the liquid in the first buffer liquid reservoir.

3. The droplet jetting applicator according to claim 1, further comprising a discharging mechanism configured to discharge, to the outside, a target for sample application to which a droplet is applied through sample application using the droplet jetting head.

4. A method for manufacturing a coated body, comprising the step of applying a droplet to an application target by using the droplet jetting applicator according to claim 1.

5. A droplet jetting applicator, comprising:

a liquid storage unit configured to store liquid;

a droplet jetting head having an inner channel through which the liquid supplied from the liquid storage unit passes, and a nozzle surface on which a nozzle connected with the inner channel is formed, the droplet jetting head configured to jet, from the nozzle, the liquid passing through the inner channel as a droplet;

a liquid supply channel configured to connect the liquid storage unit and the inner channel of the droplet jetting head so as to supply the liquid from the liquid storage unit to the droplet jetting head;

a liquid supply unit provided in the liquid supply channel, and configured to supply the liquid from the liquid storage unit to the droplet jetting head through the liquid supply channel;

a first buffer liquid reservoir provided in the liquid supply channel so as to be positioned closer to the droplet jetting head than the liquid supply unit, and formed so that the liquid flowing from the liquid supply channel drops thereinto and thereafter is reserved therein;

a decompression unit configured to decompress the inside of the first buffer liquid reservoir;

a liquid return channel configured to connect the inner channel of the droplet jetting head and the liquid storage unit so as to return the liquid having passed through the inner channel of the droplet jetting head from the droplet jetting head to the liquid storage unit;

a liquid return unit provided in the liquid return channel, and configured to return the liquid having passed through the inner channel of the droplet jetting head from the droplet jetting head to the liquid storage unit;

an on-off valve configured to open and close the liquid return channel;

a pressurizing unit configured to pressurize the liquid in the inner channel of the droplet jetting head through the first buffer liquid reservoir;

a liquid vessel configured to store liquid in which the nozzle surface of the droplet jetting head is soaked;

a moving mechanism configured to move the droplet jetting head and the liquid vessel relative to each other so that the nozzle surface of the droplet jetting head can be soaked into the liquid in the liquid vessel; and a controller configured to perform circulation preparation control in which the on-off valve is firstly closed, the liquid in the inner channel of the droplet jetting head is discharged from the nozzle by using the pressuring unit to adhere onto a tip of the nozzle as a spherical drop, while the on-off valve is closed, the moving mechanism soaks, in the liquid in the liquid vessel, the nozzle surface of the droplet jetting head with the drop adhered thereto, and the on-off valve is opened while the nozzle surface of the droplet jetting head is soaked in the liquid in the liquid vessel.

6. The droplet jetting applicator according to claim 5, wherein when a circulation operation for circulating the liquid is stopped, the controller performs circulation completion control in which the on-off valve is closed, the liquid in the inner channel of the droplet jetting head is discharged from the nozzle by using the pressurizing unit, and then the on-off valve is opened.

7. The droplet jetting applicator according to claim 5, wherein the first buffer liquid reservoir allows the liquid flowing from the liquid supply channel to flow along an inner wall surface thereof, and stores the liquid having flown along the inner wall surface therein.

8. The droplet jetting applicator according to claim 5, further comprising:

a first stirring mechanism configured to stir the liquid in the liquid storage unit; and a second stirring mechanism configured to stir the liquid in the first buffer liquid reservoir.

9. The droplet jetting applicator according to claim 5, further comprising a discharging mechanism configured to discharge, to the outside, a target for sample application to which a droplet is applied through sample application using the droplet jetting head.

10. A method for manufacturing a coated body, comprising the step of applying a droplet to an application target by using the droplet jetting applicator according to claim 5.

* * * * *